US005295926A

United States Patent [19]

Tanabe

[11] Patent Number: 5,295,926

[45] Date of Patent: Mar. 22, 1994

[54] SOFT SWORD

[76] Inventor: Testundo Tanabe, 2-16-17 Kaminagaya, Kounan-ku, Yokohama-shi, Kanagawa-ken, Japan

[21] Appl. No.: 813,803

[22] Filed: Dec. 26, 1991

Related U.S. Application Data

[63] Continuation of Ser. No. 590,353, Sep. 28, 1990, abandoned.

[30] Foreign Application Priority Data

Sep. 28, 1989 [JP] Japan ..... 1-112778

[51] Int. Cl.[5] ..... A63B 69/02

[52] U.S. Cl. ..... 482/12; 482/83; 446/473

[58] Field of Search ..... 273/67 R, 67 B, 1 R, 273/1 F, 81.5; 482/12, 10, 83; 446/473, 67

[56] References Cited

U.S. PATENT DOCUMENTS

| | | | |
|---|---|---|---|
| 519,770 | 5/1894 | MacNaughton | 273/67 R |
| 1,781,290 | 11/1930 | Margrave | 273/81.5 |
| 2,803,087 | 8/1957 | Zalkind | 482/12 |
| 4,892,303 | 1/1990 | Lohre | 446/473 |
| 5,127,871 | 7/1992 | Miller | 446/473 |
| 5,219,163 | 6/1993 | Watson | 446/473 |

OTHER PUBLICATIONS

Exploded view of a partial (FIG. 4) MacNaughton U.S. Pat. 519770, May 1984 273.67R Labeled Exploded view McNaughton.

*Primary Examiner*—Stephen R. Crow
*Assistant Examiner*—Jerome Donnelly
*Attorney, Agent, or Firm*—Louis E. Marn

[57] ABSTRACT

A soft sword comprising a core rod which comprises a short flexible center core comprising a grip and a guard constructed in one body and a soft core mounted coaxially around said flexible center core, a bag covered on said core rod by engaging at both ends of the core rod, and a grip tape wrapped onto said grip over said bag. Further, the soft sword comprises a core rod which comprises a long flexible center core comprising a grip and a guard constructed in one body and a soft core mounted coaxially around said flexible center core, a bag covered on said core rod by engaging at both ends of the core rod, and a grip tape wrapped onto said grip over said bag.

2 Claims, 2 Drawing Sheets

SOFT SWORD

This is a continuation of application Ser. No. 07/590,353, filed Sep. 28, 1990, now abandoned.

BACKGROUND OF THE INVENTION

1. Field of the Invention

The present invention relates to a soft sword used in the training of military arts (self-defense arts) in which short or long rods, etc. are operated.

2. Description of the Prior Art

To defend oneself by using a short or long rod, etc. from the attack of an enemy, considerable exercising is required. A soft sword known in the prior art is most suitable for such a training, because it will not damage the partner thanks to its softness as cushion when hitting the partner.

FIG. 6 shows such a soft sword K known in the prior art, which has been long used so far. FIGS. 7 and 8 show the exploded views of the soft sword of FIG. 6. More explicitly, FIG. 7 shows a core rod B while FIG. 8 denoting a bag to be covered onto the core rod B.

In said core rod B, numerals 1, 2 and 3 represent a center core, a grip and a guard provided at a junction portion between the grip 2 and the center core 1. The center core 1, grip 2 and the guard 3 are constructed integratedly and coaxially into one body. A soft core 4 is engaged coaxially with the center core 1 and comprises a rubber material, etc. of soft and cushioning nature. A grip tape 5 is wrapped around the grip 2 of the core rod B. Normal dimensions of such a sword as described above include 10–12 cm for the length and 2–3 cm for the diameter of the grip 2 and 48–52 cm for the length and 4.5–5.0 cm for the diameter of the soft core 4.

A bag F comprises a cotton bag unit 6 provided with an opening portion 6*a* at one end and a closing string 7 equipped at the opening portion 6*a*.

The soft sword B shown in FIG. 6 is completely assembled by covering the bag F onto the soft core 4 of said core rod B, tightening the closing string 7 and binding it onto the grip 2 at the root of the guard 3.

An exerciser grips the grip 2 covered with the grip tape 5 and swings the sword in a typical operation pattern. The sword is so light, easy operable and soft and flexible that the exerciser will not harm his partner during a training or tournament.

Nevertheless, when the sword is violently swung during a tournament of self-defense arts, etc., it sometimes occurs that the closing string 7 is loosened to release the bag F and the soft core 4 while hitting and hurting the partner's body or face with the center core 1. Such an accident as mentioned above could not be avoided even through the closing string 7 of the bag F was tightly bound.

SUMMARY OF THE INVENTION

The present invention has been achieved to solve the problem as described above. One object of the present invention is to offer such a soft sword that, even when the sword is violently swung during a tournament, etc., the bag and the soft core will not fly out of the center core and therefore will not hurt anybody with the center core.

In one aspect of the present invention, a soft sword provided according to the present invention comprises a core rod which comprises a short flexible center core comprising a grip and a guard constructed in one body and a soft core mounted coaxially around said flexible center core, a bag covered on said core rod by engaging at both ends of the core rod, and a grip tape wrapped onto said grip over said bag.

In another aspect of the present invention, a soft sword realized by the present invention comprises a core rod which comprises a long flexible center core comprising a grip and a guard constructed in one body and a soft core mounted coaxially around said flexible center core, a bag covered on said core rod by engaging at both ends of the core rod, and a grip tape wrapped onto said grip over said bag.

With said soft sword according to the present invention, it will not occur that the bag and the soft core fly out of the center core when the sword is violently swung by gripping the grip, because the bag is covered over the core rod, fixed at both ends of said core rod, and tightly bound onto the grip using the grip tape.

BRIEF DESCRIPTION OF THE ACCOMPANYING DRAWINGS

DETAILED DESCRIPTION OF PREFERRED EMBODIMENTS

Figures 1, 2, 3, 4:
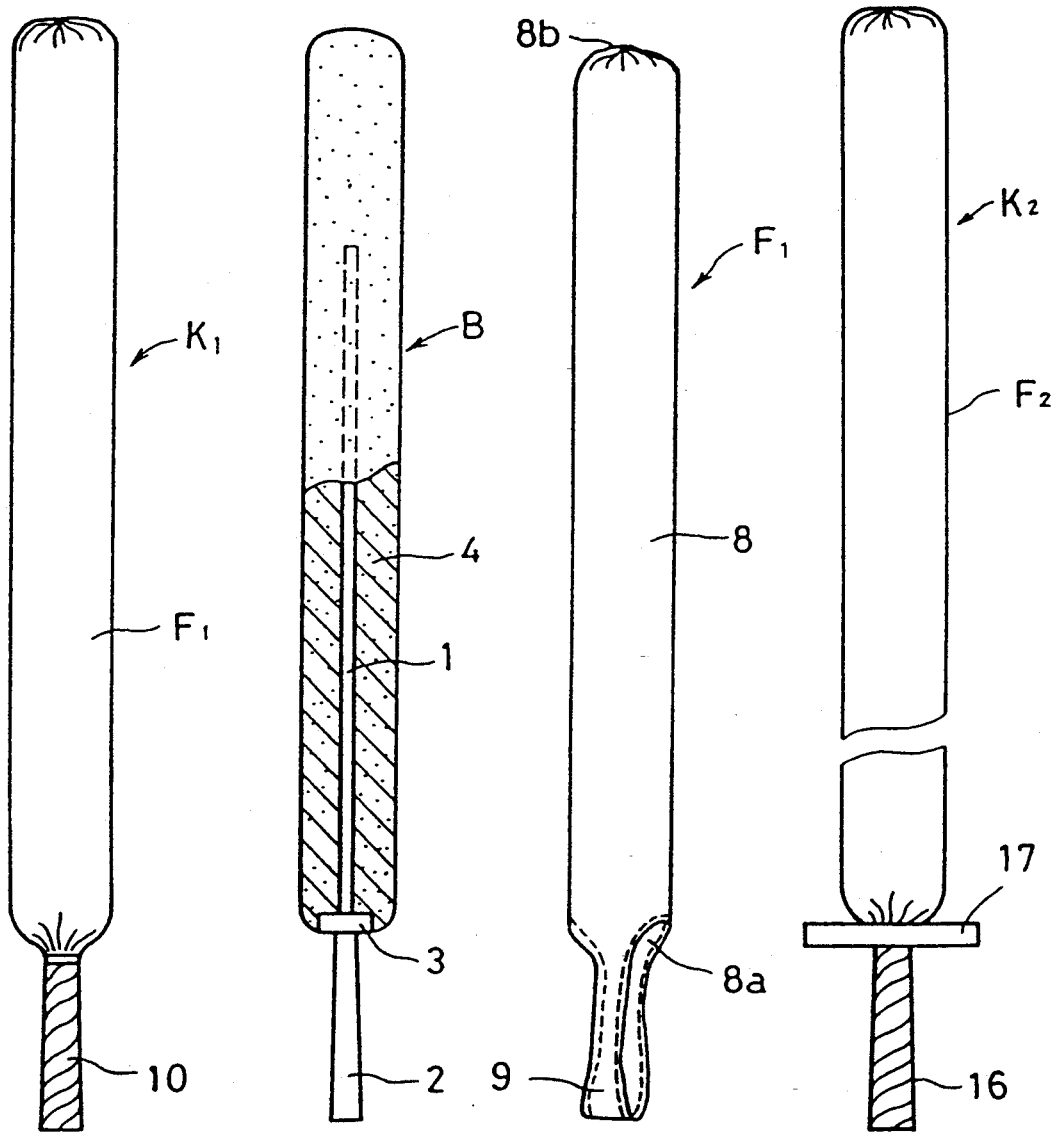
FIG. 1 is a side view of a first embodiment of the soft sword according to the present invention.
FIG. 2 is a partial section view of a core rod used in the soft sword of FIG. 1.
FIG. 3 is a side view of a bag shown in FIG. 1.
FIG. 4 is a side view of a soft sword in a second embodiment of the present invention.

A first embodiment of the present invention is described according to FIGS. 1 through 3.

FIG. 1 shows a soft sword K1, a first embodiment of the present invention. FIGS. 2 and 3 denote a core rod B1 and a bag F1, i.e. component members of the present invention. The soft sword K1 comprises said core rod B1, the bag F1 covered on said core rod B1 and a grip tape 10 (described later) wrapped onto the bag F1.

Figure 7:
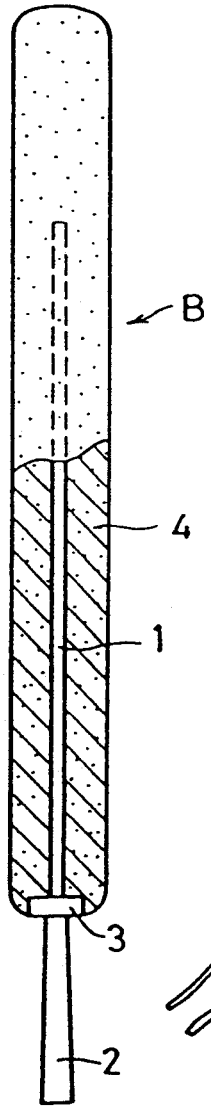
FIG. 7 PRIOR ART
FIG. 7 is a partial section view of the core rod used in the soft sword of FIG. 6.
Figure 8:
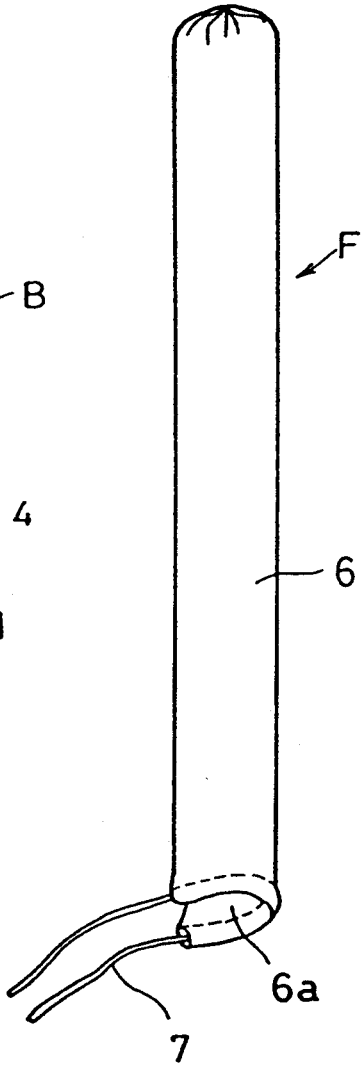
FIG. 8 PRIOR ART
FIG. 8 is a side view of the bag of FIG. 6.

The core rod B1 herein explained is the same as a conventional core rod B as shown in FIG. 7 and known in the prior art. In other words, numeral 1 through 4 represent the same component members as those in FIG. 7.

Accordingly, these members will not be described here in more detail.

The bag F1 comprises a short main unit of bag provided with an opening portion 8*a* at one end and a closing portion at the other end, and a wide string 9 provided at said opening portion 8*a* in such a manner as a string of a hand-carrying bag. The length of the main unit of bag is made suitable for the length of the soft core 4 of the core rod B1, while making the length of the string 9 suitable for the length of the grip 2. The length of the entire bag F1 is made such that, when the core rod B1 is inserted from opening portion 8*a*, the string 9 can just be hung on the grip end (terminal portion 2*a* of the grip 2). When the core rod B1 is inserted into the bag F1 while engaging the string 9 with the grip end, the bag F1 is engaged with both ends of the core rod B1 at the closing portion 8*b* and the string.

With said bag F1, at first each closing portion 8*b* and the string 9 are engaged with both ends of the core rod B1, namely the top portion and the grip end of the soft core 4, and then the bag F1 is fixed onto the grip 2 using the grip tape.

Therefore, even if the sword is violently swung by gripping the grip 2 during a tournament, etc., it never occurs that the bag F1 and the soft core 4 may come off from the center core 1 and may fly off. Consequently, the partner will never be hurt with the center core 1.

Figure 5:
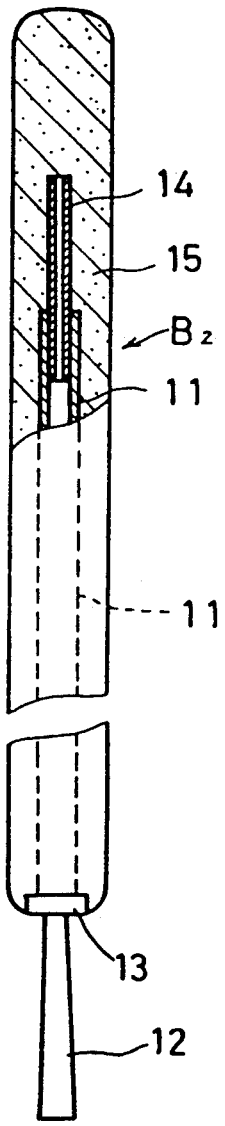
FIG. 5 is a partial section view of a core rod used in the soft sword of FIG. 4.
Figure 6:
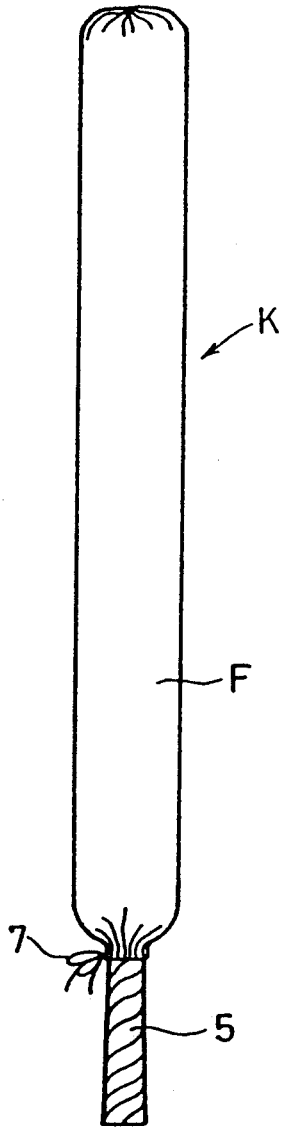
FIG. 6 PRIOR ART
FIG. 6 is a side view of a conventional soft sword known in the prior art.

FIGS. 4 and 5 show a second embodiment. The soft sword K1 of the first embodiment is as short as about 60 cm in the entire length. However, the soft sword K2 of the second embodiment shown in FIG. 4 is a long one in a length of about 1 m.

As the length of the entire soft sword of the second embodiment is so long as about 1 m, the construction of the core rod B2 is different from that of the core rod B1 of the first embodiment, as shown in FIG. 5. FIG. 5 shows the detailed construction of the core rod B2.

Referring to FIG. 5, symbol numerals represent various component members; 11 for a first center core of a cylindrical shape having flexibility, 12 for a grip of said center core, 13 for a guard provided at a junction between the grip 12 and the center core 11, 14 for a second center core in a cylindrical shape having flexibility, and 15 for a cylindrical soft core fixed coaxially onto both first and second center cores 11 and 14, said cylindrical soft core 15 comprising a rubber material, etc. which can function as a cushion.

The length and diameter of the grip 12 are 24~26 cm and 2~3 cm, respectively. The same values of the first and second center cores are 49~52 cm and 1.5~1.6 cm and 25~27 cm and 1.2~1.3 cm, respectively. When both centers 11 and 14 are connected, the entire length is 69~71 cm. The length and diameter of the soft core are 74~76 cm and 44~45 cm, respectively. However, these dimensions are only typical and not limited values.

Referring to FIG. 4, the soft sword K2 comprises said core rod B2, the bag F2 in the same composition as that of FIG. 3 as covered on said center rod B2, the grip 12 with the grip tape 16 wrapped thereon and the guard 17 slipped over the grip tape 16 up to the root of the grip 12 and fixed in there.

The effects of the second embodiment soft sword K2 are the same as those of said first embodiment soft sword K1. The difference between these embodiments K1 and K2 is only how to use them.

According to the present invention, the bag is first fixed at both ends of the core rod and then tightened onto the grip using the grip tape. Therefore, even if the soft sword is violently swung during a tournament, etc., it never occurs that the bag and the soft core come off from the center core and fly out. Consequently, nobody will be hurt by the center core. Such an excellent soft sword is now available by the present invention.

What is claimed is:

1. A soft sword assembly, which comprises:

a core rod having a flexible center core, an intermediate guard and a grip having a free end, said flexible center core, said intermediate guard and said grip integrally constructed into one integral body, in the form of a sword;

a soft core mounted coaxially about said flexible center core;

a bag comprised of a bag body provided with upper and lower closing portions at both ends and said lower closing portion being a strap-shaped portion providing access at both sides into said bag body for said soft core mounted on said flexible center core of said core rod, said soft core being inserted into said bag, wherein said grip is surrounded by said closing portion, said strap shaped portion extending towards and engaging said free end of said grip of said core rod;

a grip tape wrapped onto said strap-shaped portion engaging said grip of said core rod; and a guard slipped over said grip tape and positioned at a root of said grip proximate said intermediate guard.

2. The soft sword as defined in claim 1 whereas said flexible center cord is comprised of a flexible cylindrically-shaped core member defining an orifice and a flexible center core member disposed in said orifice of said cylindrically-shaped core member and extending coaxially outwardly therefrom.

* * * * *